United States Patent [19]

Ham et al.

[11] Patent Number: 4,973,400

[45] Date of Patent: Nov. 27, 1990

[54] HEAT EXCHANGER FOR HEATING THE CHARGE OF A CATALYTIC REFORMING UNIT OPERATING UNDER LOW PRESSURE

[75] Inventors: Pierre Ham, La Celle St. Cloud; Jean de Bonneville, Rueil-Malmaison, both of France

[73] Assignee: Institut Francais Du Petrole, Rueil-Malmaison, France

[21] Appl. No.: 365,259

[22] Filed: Oct. 12, 1989

[30] Foreign Application Priority Data

Oct. 13, 1988 [FR] France ..... 88 13627

[51] Int. Cl.[5] ..... C10G 35/04

[52] U.S. Cl. ..... 208/134

[58] Field of Search ..... 208/134

[56] References Cited

U.S. PATENT DOCUMENTS 4,172,027 10/1979 Ham et al. ..... 208/139

*Primary Examiner*—Curtis R. Davis

*Attorney, Agent, or Firm*—Millen, White, & Zelano

[57] ABSTRACT

The invention relates to a means for heating the charge of a catalytic reforming unit operating under low pressure.

The invention more particularly relates to an apparatus having in combination a first heat exchanger (6), in which the gaseous recycling-liquid charge mixture introduced by pipe (5) is completely vaporized and a second exchanger (9) in which the charge is heated to an adequate temperature by indirect contact with the reforming effluent arriving by pipe (17), which successively passes through the two heat exchangers.

3 Claims, 1 Drawing Sheet

Figure 1:
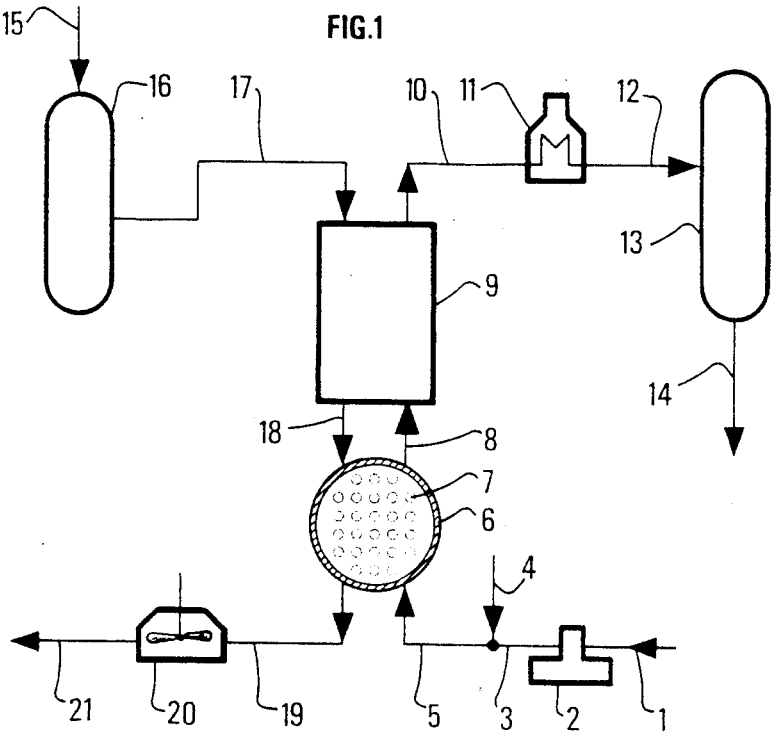

HEAT EXCHANGER FOR HEATING THE CHARGE OF A CATALYTIC REFORMING UNIT OPERATING UNDER LOW PRESSURE

In catalytic reforming processes, the tendency is to operate at ever lower pressures. A few years ago, it was standard practice to operate in reactors at pressures of 10 bars ($10\times10^5$ Pascal), whereas now the aim is to operate at about 3 bars ($3\times10^5$ Pascal).

An improved reforming process consists of operating in at least two moving bed reactors in series, which can optionally be associated with fixed bed reactors. Such processes are described in the Applicant's U.S. Pat. No. 4,133,733 and 4,172,027.

The charge introduced into the first reactor is generally at least partly preheated by indirect heat exchange with the effluent of the last reactor. The thus preheated charge generally passes through a furnace before being admitted into the first reactor. The heat exchanger used is of the conventional tubular or plate type.

The liquid charge is introduced with the recycling gas into the said exchanger and is substantially vaporized on leaving the exchanger. When the pressure used in the reactors and the ancillary devices, such as the exchanger in question, is approximately 10 bars, the value of said pressure permits a correct circulation of the charge through the exchanger tubes or plates.

The exchanger and its use then cause no particular realization problems. However, when the pressure used in the reactors is low and in accordance with the present tendency in the refining industry, the path of the charge in the exchanger is less satisfactory. Moreover , when using a high pressure, it is possible to allow within the reforming unit a relatively high pressure drop (delta P) in the exchanger.

However, when the reaction pressure (consequently also the pressure in the exchanger) is low, it is not possible to accept high pressure drops (delta P) and the latter must be limited.

Therefore, to meet this objective, it is important for the sections of the exchangers to be wider. However, wide sections are prejudicial to a correct distribution of the charge-recycling gas mixture in the exchanger. Moreover, the low delta P does not make it possible to guarantee a homogeneous flow in all exchanger sections. Therefore, even if large exchangers are used, vaporization is not satisfactory.

The object of the present invention makes it possible to adapt to low pressure catalytic reforming units, a system of exchangers able to operate correctly. The invention relates to a novel process and a novel low pressure exchange apparatus making it possible to carry out the correct heating of the charge and to rapidly and completely vaporize said charge.

Thus, when the pressure is low in an exchanger, it is much easier to circulate within such an exchanger a gaseous fluid rather than a mixed gaseous-liquid fluid. Therefore the principle of the invention consists of vaporizing the charge in a first exchanger and then bringing the charge to a higher temperature in a second exchanger. With the charge vaporized, it is easier to circulate it even if the pressure is low and even if the section of said second exchanger is high. Moreover, the system of the invention permits a maximum limitation of the pressure drops (delta P).

The apparatus according to the invention is a combination of two exchangers in series traversed by the charge. Preferably, the first exchanger is an indirect tubular exchanger with countercurrent flow of charge and reaction effluent, whilst the second exchanger is an indirect plate or tubular exchanger.

Therefore the invention relates to a process for catalytic reforming at low pressure of between 1 and 7 bars of a liquid hydrocarbon charge in at least on reaction zone, with the formation of a gas-accompanied reaction effluent, said gas (or recycling gas) being recycled at least partly into such a reaction zone, the process being characterized in that a mixed gaseous-liquid fluid constituted by:

a. the liquid charge, initially at a temperature between 80 and 110° C. and b. recycling gas is heated by indirect contact with at least part of the reaction effluent in two heat exchange zones arranged in series, the charge being introduced into the first exchange zone where it is substantially vaporized and is then passed into the second heat exchange zone and also characterized in that the reaction effluent is firstly introduced into the second exchange zone at a temperature between 450 and 580° C. and then into the first exchange zone from which it is withdrawn at a temperature between 80 and 110° C., the pressure drop between the exit point of the charge in the second exchange zone and the inlet point of the charge in the first exchange zone being between 0.3 and 1.5 bar ($0.3\times10^5$ and $1.5\times10^5$ Pascal).

More specifically, in the process according to the invention, the liquid charge, mixed with the recycling gas from the catalytic reforming unit, is introduced at a temperature between 80 and 110° C. into a first exchange zone operating in two-phase manner (liquid-gas), in which at a pressure between 1 and 7 bars ($10^5$ Pascal and $7\times10^5$ Pascal) and preferably between 2 and 6.5 bars ($2\times10^5$ Pascal), the charge being substantially vaporized by indirect contact (and preferably in countercurrent with the reaction effluent). The charge vaporized in the first exchange zone is then passed into a second exchange zone operating in single-phase manner (gas) at a pressure slightly below that used in the first exchange zone due to a slight pressure drop.

On leaving the second exchange zone, a charge is recovered at a temperature between approximately 430 and 520° C. The pressure drop between the exit of the charge from the second exchanger and the entry of the charge into the first exchanger is between 0.3 and 1.5 bar ($0.3\times10^5$ and $1.5\times10^5$ Pascal).

The reaction effluent from the catalytic reforming unit circulates in countercurrent manner with the charge in each of the two exchange zones. It enters the second exchange zone at a temperature between 450 and 580° C. and leaves the second exchange zone at generally between 80 and 110° C. The charge drawn off from the second exchange zone is passed into the first catalytic reforming zone after having optionally passed through a furnace to ensure that the charge has an adequate temperature. In a preferred manner, the ratio of the exchange surfaces between the first and second exchange zones is between 1/10 and 5/10 and preferably between 2/10 and 4.5/10 and more particularly between 2.5/10 and 4/10.

Another advantage of the process and apparatus according to the invention is that on using a plate exchanger for the second exchanger and a tubular exchanger for the first exchanger during the condensation of the effluent the walls with which the effluent is in contact become dirty, but as the same can be dismantled, it can be easily cleaned. It is known that plate exchangers are not dismantlable and if they become dirty the only possibility is to chemically clean the exchanger. In the process and apparatus according to the invention, the charge circulating in the second exchanger and which is preferably a plate exchanger has already been vaporized, so that there is no dirtying of the second exchanger.

The invention also relates to an apparatus, characterized in that it comprises in combination (cf. FIG. 1):

a first heat exchanger (6) provided with a pipe (5) for introducing a first fluid containing the liquid charge and a recycling gas from a catalytic reforming unit, provided with a pipe (8) for drawing off said fluid and also a drawing-off pipe (19) and an introduction pipe (18) for a second fluid from the second exchanger (9) defined hereinafter;

and a second heat exchanger (9) provided with an introduction pipe (8) and a drawing-off pipe (10) for said first fluid from the first heat exchanger and provided with an introduction pipe (17) and a drawing-off pipe (18) for said second fluid, said second fluid being at least partly constituted by the effluent of a reforming reactor, said second fluid being in indirect contact with said first fluid in each of the two exchangers (6) and (9).

In a preferred manner, the first exchanger is a tubular exchanger and the second exchanger a plate exchanger.

Figure 2:
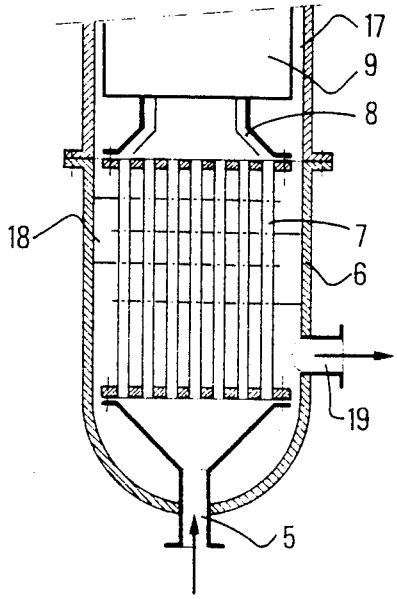

FIGS. 1 and 2 illustrate the invention.

In FIG. 1, the liquid charge arriving by pipe 4 is mixed in line 5 with the recycling gas from the reforming unit, said gas coming from pipe (1) through pump (2) and pipe (3). The mixed fluid (or double gas-liquid phase) enters a tubular (7) exchanger (6) in indirect countercurrent with the reaction effluent entering exchanger (6) by line (18) and leaving by line (19) to pump (20) and pipe 21). The entirely vaporized charge and the recycling gas pass out of exchanger (16) by pipe (8) and enter a plate exchanger (9), where they are heated by indirect contact with the reaction effluent (line 17) from the last reactor (16) of a series of reforming reactors, the said reactor being supplied with charge by a pipe (15). The charge and the recycling gas are drawn off from the plate exchanger (9) by pipe (10), pass through furnace (11) and by pipe (12) supply the first reforming reactor (13) and then continue by line (14) to other reforming reactors.

FIG. 2 shows a particular realization of the apparatus according to the invention having a tubular (7) exchanger (6) and a plate exchanger (9).

EXAMPLE 1

For example, use was made of a tubular exchanger and a plate exchanger preceding, in series, a catalytic reforming unit operating at 3 bars ($3\times10^5$ Pascal).

| First exchanger. | |
|---|---|
| intake temperature of the mixed fluid (charge - recycling gas): | 89° C. |
| inake pressure of the mixed fluid: | 6.2 bars ($6.2 \times 10^5$ Pascal) |
| outlet temperature of the effluent: | 102° C. |
| outlet pressure of the effluent: | 3.8 bars ($3.8 \times 10^5$ Pascal) |
| inlet temperature of the effluent: | 200° C. |

| Second Exchanger. | |
|---|---|
| inlet temperature of the entirely vaporized mixed fluid: | 140° C. |
| outlet temperature of the mixed fluid: | 465° C. |
| outlet pressure of the mixed fluid: | 5.8 bars ($5.8 \times 10^5$ Pascal) ($0.4 \times 10^5$ Pascal) |
| outlet temperature of the effluent: | 200° C. |
| inlet temperature of the effluent: | 500° C. |
| inlet pressure of the effluent: | 4.2 bars ($4.2 \times 10^5$ Pascal) |
| total pressure drop: 6.2 − 5.8 = | 0.400 bar ($0.4 \times 10^5$ Pascal) |
| exchange surface in the first exchanger: | 1500 $m^2$ |
| exchange surface in the second exchanger: | 4000 $m^2$ |
| total exchange surface: 4000 + 1500 = | 5500 $m^2$ |
| ratio of surfaces $\frac{\text{first exchanger:}}{\text{second exchanger:}}$ $\frac{1500}{4000}$ = | $\frac{3.75}{10}$ |

EXAMPLE 2 (Comparative)

As a comparative example, use was successively made of a single plate exchanger and a single tubular exchanger. Each exchanger had an exchange surface of 5500 $m^2$, i.e. equal to all the exchange surfaces of the two exchangers of the preceding example. The inlet temperatures of the mixed fluid and the reforming effluent were respectively 89 and 500° C.

Every effort was made to have a minimum pressure drop, so that the reforming reaction pressure was 3 bars ($3\times10^5$ bars), as in Example 1.

Under these conditions, the charge was not vaporized in an appropriate manner and the operation of the exchanger was unstable.

We claim:

1. Process for catalytic reforming at low pressure of between 1 and 7 bars of a liquid hydrocarbon charge in at least one reaction zone, with the formation of a gas-accompanied reaction effluent, said gas (or recycling gas) being recycled at least partly into such a reaction zone, the process being characterized in that a mixed gaseous-liquid fluid constituted by:

a. the liquid charge, initially at a temperature between 80 and 110° C. and b. recycling gas is heated by indirect contact with at least part of the reaction effluent in two heat exchange zones arranged in series, the charge being introduced into the first exchange zone where it is substantially vaporized and s then passed into the second heat exchange zone and also characterized in that the reaction effluent is at least partly introduced into the second exchange zone at a temperature between 450 and 580° C. and then into the first exchange zone from which it is withdrawn at a temperature between 80 and 110° C., the pressure drop between the exit point of the charge in the second exchange zone and the inlet point of the charge in the first exchange zone being between 0.3 and 1.5 bar ($0.3\times10^5$ and $1.5\times10^5$ Pascal).

2. Process according to claim 1 in which the ratio of the exchange surfaces in the first and second exchange zones is between 1/10 and 5/10.

3. Process according to claim 2 in which the ratio is between 2/10 and 4.5/10.

* * * * *